US009797202B2

(12) United States Patent
Rindeskar et al.

(10) Patent No.: US 9,797,202 B2
(45) Date of Patent: Oct. 24, 2017

(54) DRILL BIT FOR ROCK DRILLING TOOL, AND ROCK DRILLING TOOL

(71) Applicant: SANDVIK INTELLECTUAL PROPERTY AB, Sandviken (SE)

(72) Inventors: Andreas Rindeskar, Hofors (SE); John Hammargren, Ockelbo (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 499 days.

(21) Appl. No.: 14/357,267

(22) PCT Filed: Oct. 29, 2012

(86) PCT No.: PCT/EP2012/071367

§ 371 (c)(1),
(2) Date: May 9, 2014

(87) PCT Pub. No.: WO2013/068262

PCT Pub. Date: May 16, 2013

(65) Prior Publication Data

US 2014/0299388 A1 Oct. 9, 2014

(30) Foreign Application Priority Data

Nov. 11, 2011 (EP) ..... 11188761

(51) Int. Cl.
*E21B 10/567* (2006.01)
*E21B 10/40* (2006.01)

(52) U.S. Cl.
CPC ..... *E21B 10/5673* (2013.01); *E21B 10/40* (2013.01)

(58) Field of Classification Search
CPC ..... E21B 10/36; E21B 10/38; E21B 10/40; E21B 10/5673
See application file for complete search history.

(56) References Cited

U.S. PATENT DOCUMENTS 3,269,470 A * 8/1966 Kelly, Jr. ..... E21B 10/56 175/415
4,151,889 A 5/1979 Lister
2007/0137900 A1* 6/2007 Bjork ..... E21B 10/38 175/414

FOREIGN PATENT DOCUMENTS

DE 2717717 A1 10/1978
DE 19630639 A1 2/1998
RU 19082 U1 8/2001
SU 1266954 A1 10/1986

(Continued)

*Primary Examiner* — David L Andrews
(74) *Attorney, Agent, or Firm* — Corinne R. Gorski

(57) ABSTRACT

A drill bit for rock drilling tools includes a drill bit head having a front surface including a face surface defining a forward-most end of the drill bit head. The face surface has an outer edge, a gauge surrounding the face surface, the gauge having an inner edge, and a transition region that extends in a direction of a longitudinal axis of the drill bit between the outer edge of the face surface and the inner edge of the gauge. An entirety of the face surface from which the cutting surfaces extend is non-flat so that a center of the face surface is axially forward of the outer edge of the face surface. The gauge includes a first gauge surface defining a first angle with the longitudinal axis over a first portion of a circumference of the gauge and a second gauge surface defining a second angle with the longitudinal axis over a second portion of the circumference of the gauge.

16 Claims, 14 Drawing Sheets

(56) References Cited

FOREIGN PATENT DOCUMENTS

| | | | |
|---|---|---|---|
| WO | 92/11436 | A1 | 7/1992 |
| WO | 03/031763 | A1 | 4/2003 |

* cited by examiner

DRILL BIT FOR ROCK DRILLING TOOL, AND ROCK DRILLING TOOL

RELATED APPLICATION DATA

This application is a §371 National Stage Application of PCT International Application No. PCT/EP2012/071367 filed Oct. 29, 2012 claiming priority of EP Application No. 11188761.8, filed Nov. 11, 2011.

BACKGROUND AND SUMMARY

The present invention relates to drill bits for rock drilling tools and, more particularly, to such drill bits that use hard buttons.

In drill bits 1 used for rock drilling of the general type shown in FIG. 5A (illustrating wear patterns on a known rock drilling bit, Part No. 7738-5348-S48 available from Sandvik Mining and Construction Tools AB, Sandviken, Sweden), sliding friction of the buttons 2, usually cemented carbide buttons, against a hole wall creates diametrical wear on the buttons as shown by the illustrated wear patches 3. It is ordinarily desirable to extend the life of the buttons 2 on such drill bits 1.

The inventors suggest that increasing the amount of area of the buttons 2 that will project into contact with the hole wall should be expected to reduce radial contact pressure on the buttons. The inventors caution, however, that the force is not evenly distributed on all buttons, and likely only two buttons of a bit 1 such as is shown in FIG. 5A are in contact with the hole wall at a given time. The graph of FIG. 4A attempts to illustrate how, as a bit 1 is worn down from 50 mm diameter with new buttons to 48 mm diameter, the amount of wear area increases, i.e., the size of the wear patches 3 on the buttons 2 increases. The following equation is believed to approximate the radial pressure on the carbide buttons 2 of the bit 1:

$$p_r(r) = \frac{F_r}{A(r)} \quad 1)$$

where:

$p_r$=Radial pressure on carbide (N/mm2)

$F_r$=Radial force on carbide (N)

A(r)=Radial projected area of carbide (mm2)

The volume of wear from the buttons is a function of bit diameter, i.e.:

$$V_c = f(r) \quad 2)$$

where:

$V_c$=Carbide wear volume (mm3)

r=radius of bit.

The total amount of material (e.g., carbide) to be worn down, i.e., the volume of carbide wear, when the bit is worn from one diameter to another highly influences the bit life. Volume is a truly geometrical function depending on the design of the bit, shown in the graph of FIG. 4B, which illustrates how the volume of the buttons 2 worn away as the bit 1 is worn down from 50 mm diameter with new buttons to 48 mm diameter. As the diameter of the bit becomes smaller, the amount of material that must be worn away increases substantially.

Sliding surfaces in contact under pressure creates wear and the bit wear is dependent on the volume available to be worn down and the pressure applied to the worn area. The inventors have recognized that increasing the area in contact and the volume to be worn down at a specific diameter highly influences bit service life. Consequently, the inventors maintain that, to extend bit life, it is desirable that the area of the bit in contact with the surface of the hole being drilled should increase steeply with decreasing diameter, and more volume of material to be worn down should be provided.

According to an aspect of the present invention, a drill bit for rock drilling tools comprises a drill bit head having a front surface comprising a face surface from which a plurality of cutting surfaces are adapted to extend defining a forward-most end of the drill bit head, the face surface having an outer edge, and a gauge surrounding the face surface, the gauge having an inner edge. A transition region extends in a direction of a longitudinal axis of the drill bit between the outer edge of the face surface and the inner edge of the gauge, and an entirety of the face surface from which the cutting surfaces are adapted to extend is non-flat so that a center of the face surface is axially forward of the outer edge of the face surface.

According to another aspect of the present invention, the gauge comprises a first gauge surface defining a first angle with the longitudinal axis over a first portion of a circumference of the gauge and a second gauge surface defining a second angle with the longitudinal axis over a second portion of the circumference of the gauge.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
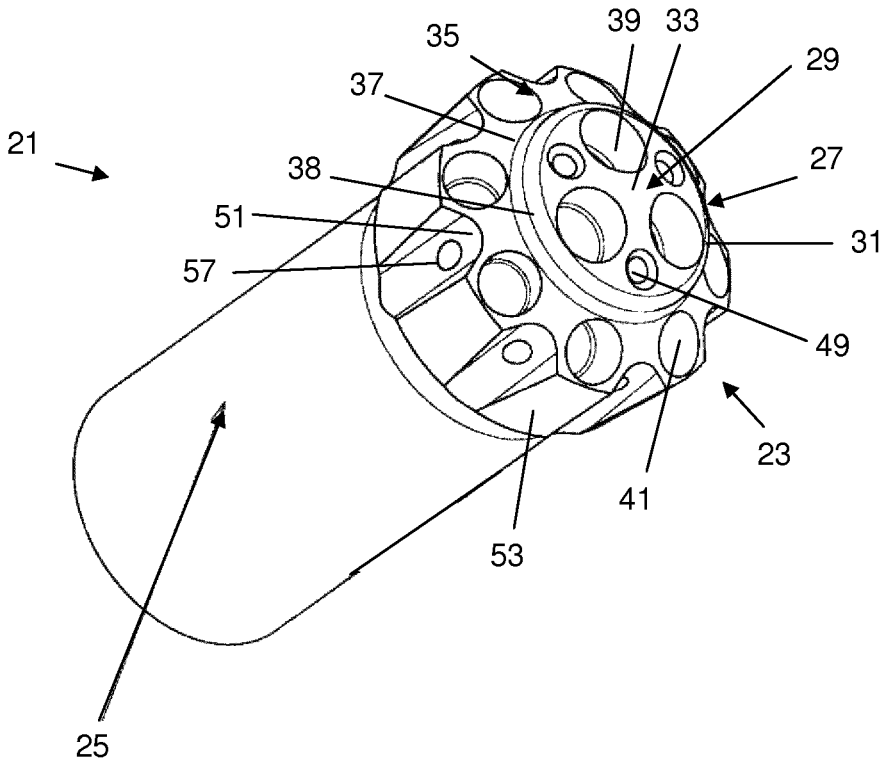
FIG. 1A is a perspective view of a drill bit according to an aspect of the present invention.
Figure 1E:
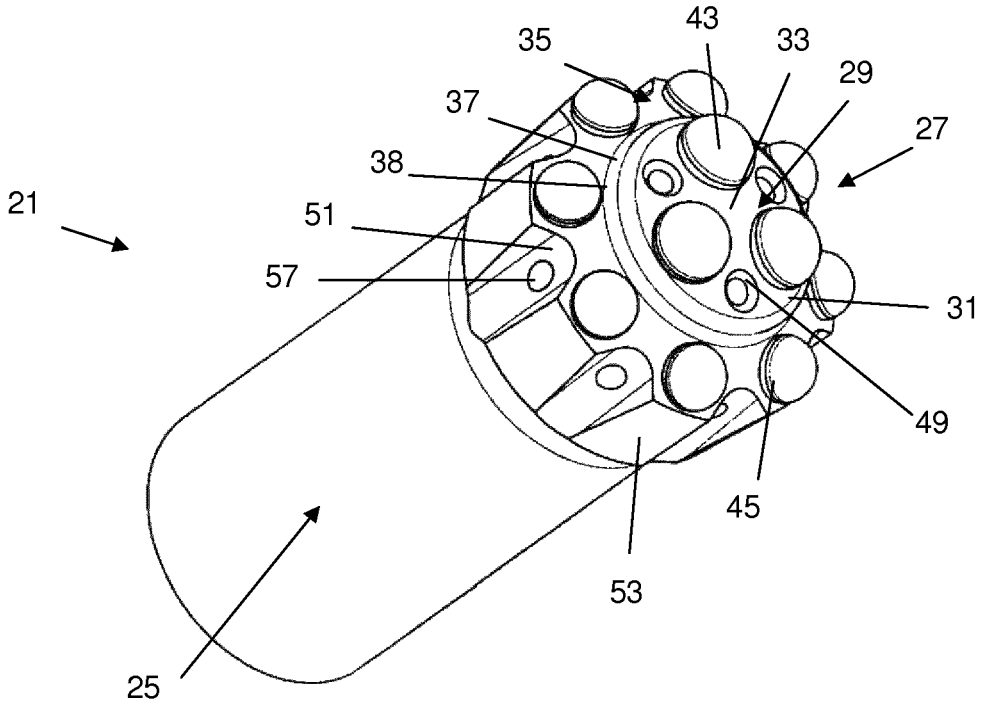
FIG. 1E is a perspective view of the drill bit of FIG. 1A with buttons shown according to an aspect of the present invention.
Figure 1C:
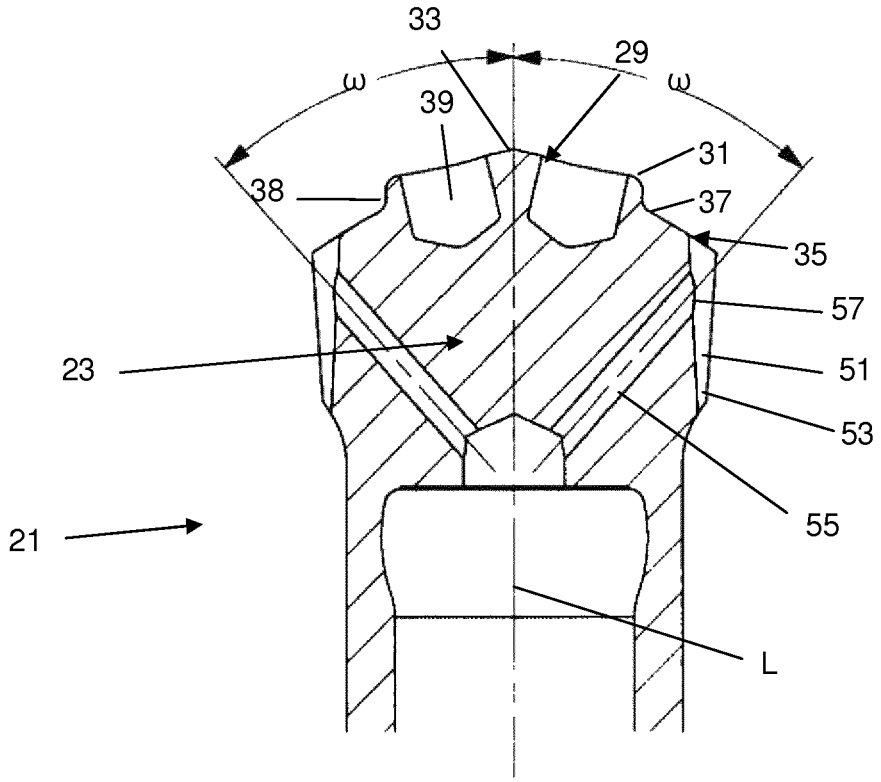
FIG. 1C is a side, cross-sectional view of the drill bit of FIG. 1A taken at section 1C-1C of FIG. 1B.
Figure 1B:
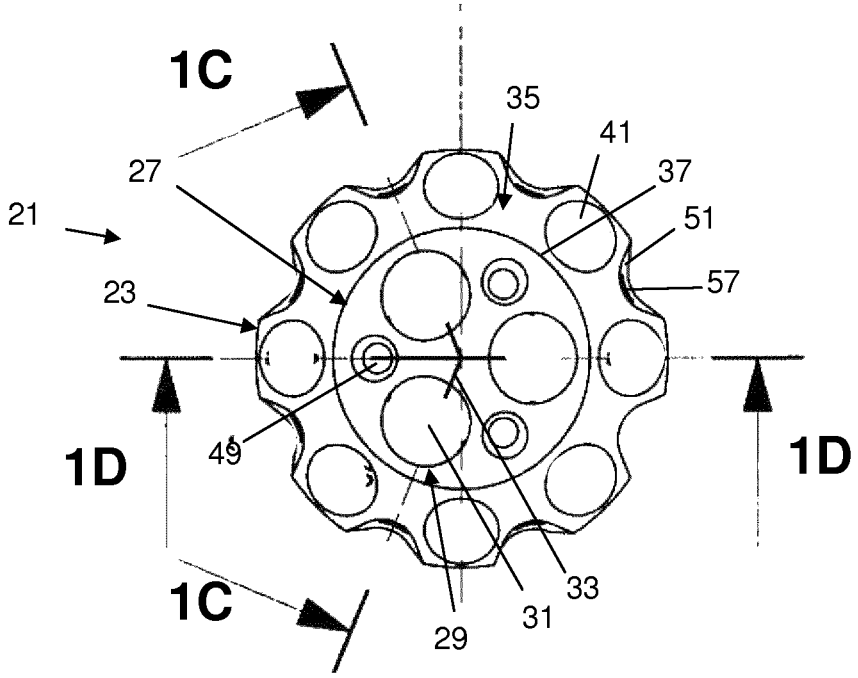
FIG. 1B is a top view of the drill bit of FIG. 1A.
Figure 1D:
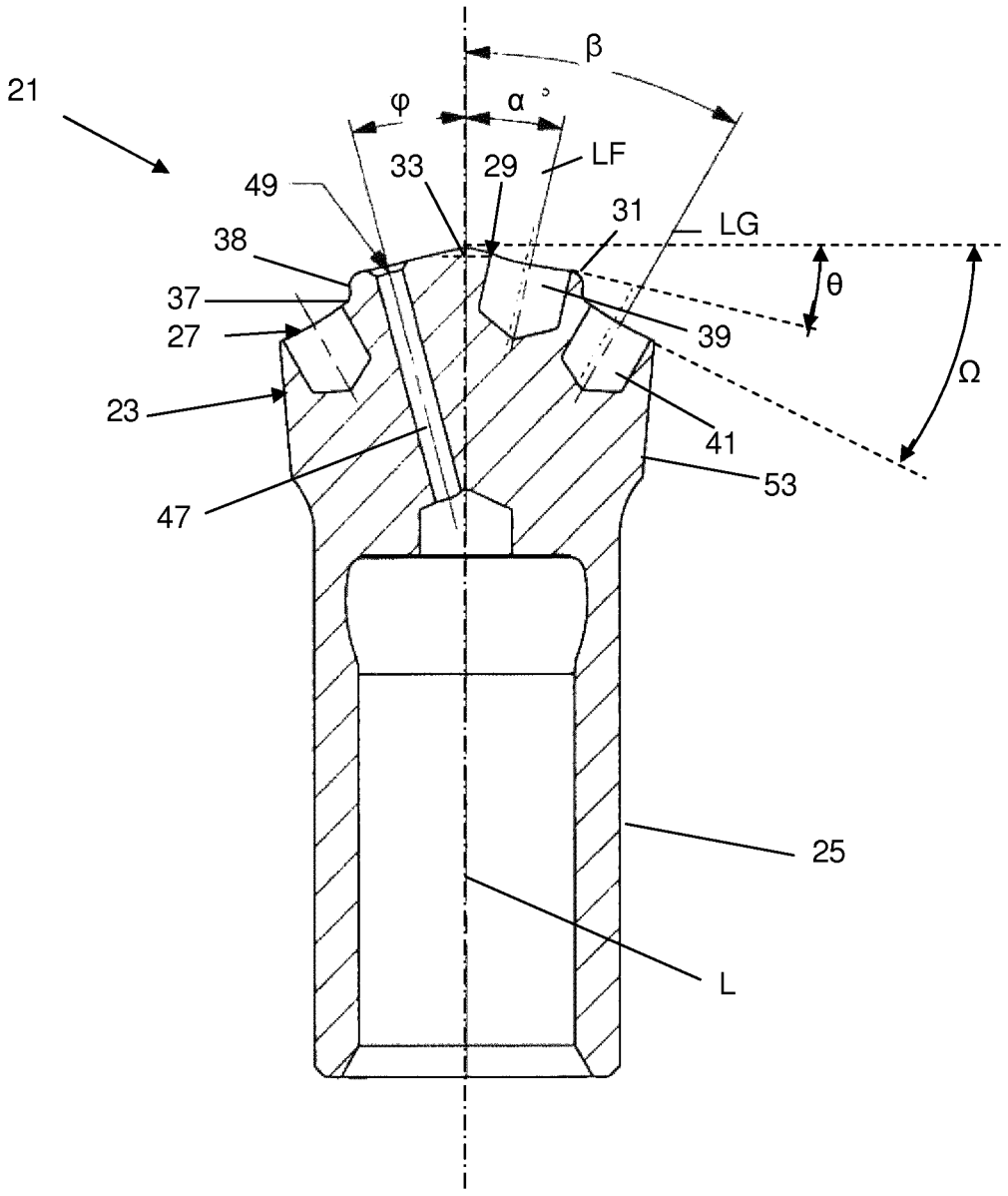
FIG. 1D is a side, cross-sectional view of the drill bit of FIG. 1A taken at section 1D-1D of FIG. 1B.
Figure 1G:
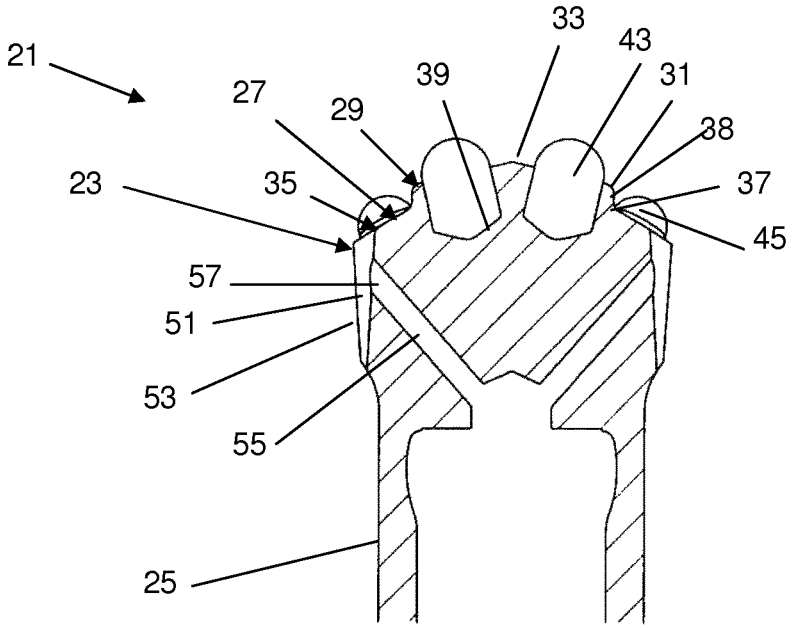
FIG. 1G is a side, cross-sectional view of the drill bit of FIG. 1E taken at section 1G-1G of FIG. 1F.
Figure 1F:
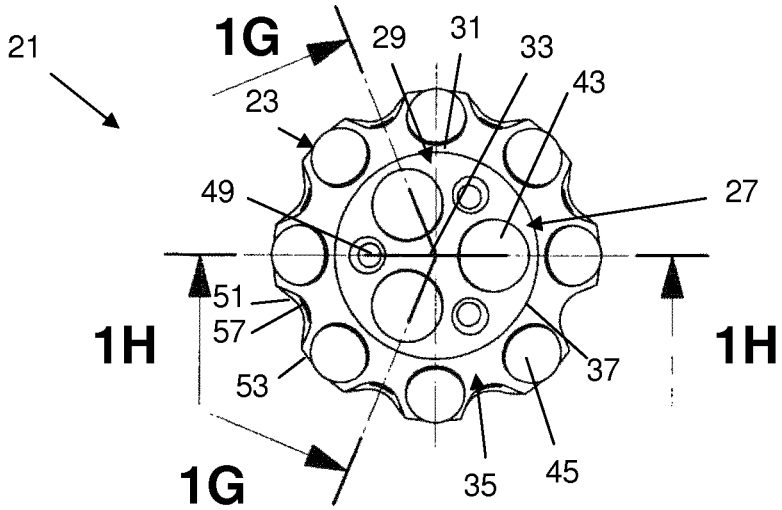
FIG. 1F is a top view of the drill bit of FIG. 1E.
Figure 1H:
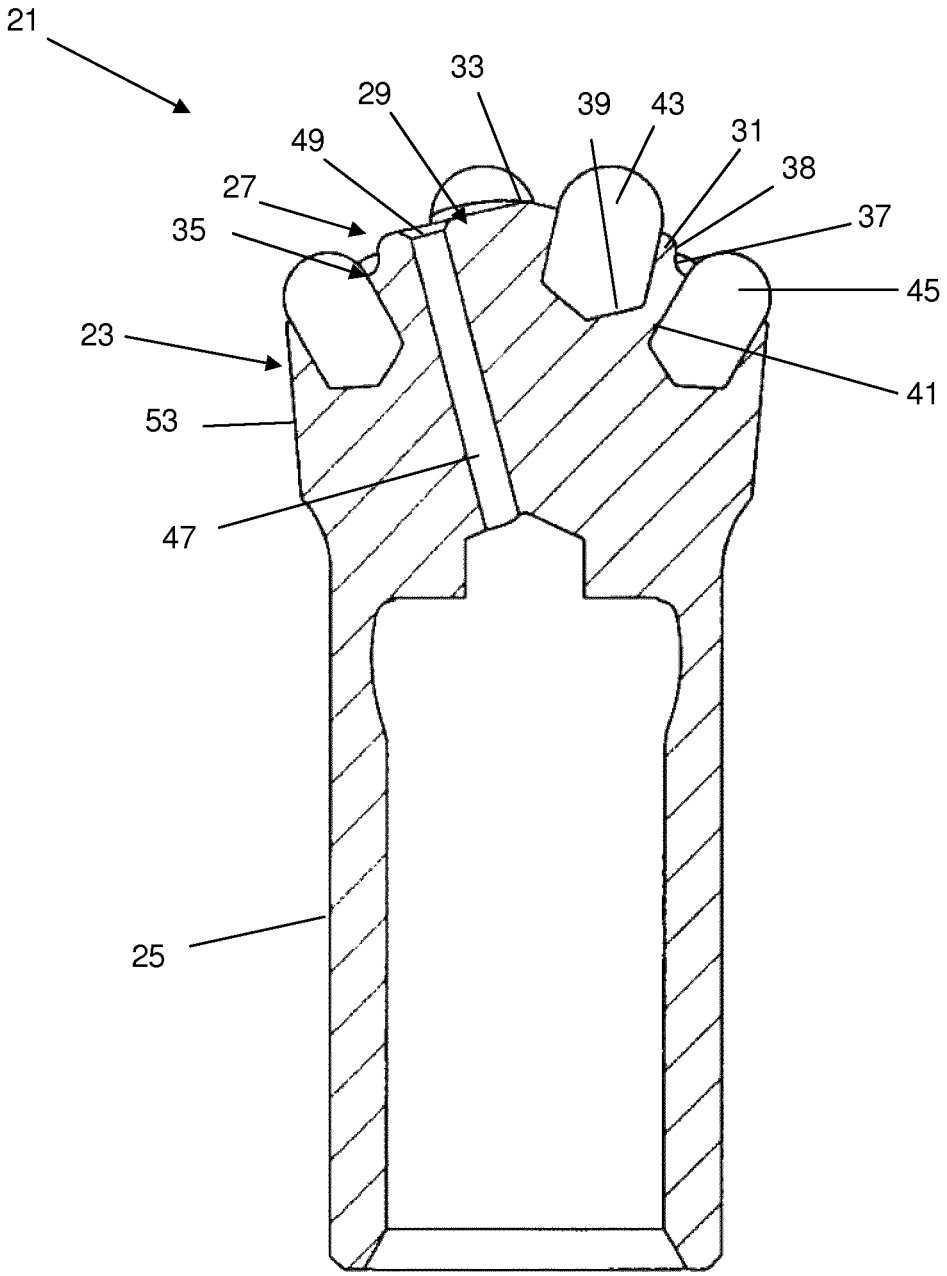
FIG. 1H is a side, cross-sectional view of the drill bit of FIG. 1E taken at section 1H-1H of FIG. 1F.

FIGS. 1A-1H and 2A-2I show embodiments of a drill bit 21 and 121 for rock drilling tools according to aspects of the present invention. According to an aspect of the invention, the drill bits 21 or 121 illustrated can be used in a variety of drilling tools such as down-the-hole hammers 100 (shown schematically in FIG. 3A) wherein a piston 101 in a casing 102 is intended to strike an anvil of the drill bit 21. The same arrangement (not shown) can be used for the drill bit 121. Drill bits 21' with features similar features of the drill bit 21 but for use with top hammer-type rock drills 200 (shown schematically in FIG. 3B) wherein compressive pulses are delivered to the drill bit 21' via the tube or rod 202 can also be provided according to another aspect of the invention. The same arrangement (not shown) can be used for the drill bit 121. The following description describes the drill bits 21 and 121 intended for use with a down-the-hole hammer, however, it will be appreciated that the description applies equally well to a drill bit such as is used in rock drill applications, except where otherwise indicated.

With reference to the drill bit 21 shown in FIGS. 1A-1H, the drill bit comprises a drill bit head 23 having a skirt 25 and a front surface 27. The front surface 27 comprises a face surface 29 from which a plurality of cutting surfaces are adapted to extend. The face surface 29 defines a forward-most end of the drill bit head 23. The face surface 29 has an outer edge 31. An entirety of the face surface 29 from which the cutting surfaces are adapted to extend is non-flat and a center 33 of the face surface is axially forward of the outer edge 31 of the face surface along a longitudinal axis L of the drill bit 21. As seen in FIGS. 1C-1D and 1G-1H, the face surface 29 is ordinarily conical or frustoconical (shown by dotted lines in FIGS. 1B and 1D), however, it may have other forms, such as being in the form of a plurality of concentric truncated cones, or a spherical or truncated sphere shape. The face surface 29 shown in FIGS. 1A-1H forms an angle θ (FIG. 1D) with a perpendicular to the longitudinal axis L.

The front surface 27 further comprises a gauge 35 surrounding the face surface 29. The gauge 35 has an inner edge 37. A transition region 38 extends in the direction of the longitudinal axis L of the drill bit 21 between the outer edge 31 of the face surface 29 and the inner edge 37 of the gauge 35. The transition region 38 on the drill bit 21 is ordinarily substantially circular and cylindrical. The gauge 35 ordinarily defines an angle Ω (FIG. 1D) with the perpendicular to the longitudinal axis L of the drill bit that is different from the angle θ that the face surface 29 forms with the perpendicular to the longitudinal axis L of the drill bit. A presently preferred design for the drill bit 21 includes a face surface 29 that forms an angle θ of about 13° with the perpendicular to the longitudinal axis L. A presently preferred design for the drill bit 21 includes a gauge 35 that forms an angle Ω of about 30° with the perpendicular to the longitudinal axis L.

At least one and ordinarily a plurality of face holes 39 are provided in the face surface 29 and at least one and ordinarily a plurality of gauge holes 41 are provided in the gauge 35 for receiving face buttons 43 and gauge buttons 45 (face and gauge buttons are seen in FIGS. 1E-1H, and not shown in FIGS. 1A-1D), respectively. The buttons 43 and 45 are typically made of an extremely hard material, such as cemented carbide, and are ordinarily harder than the material forming the drill bit head 23. A longitudinal axis LF of the at least one face hole 39 forms a non-zero angle α (FIG. 1D) with the longitudinal axis L of the drill bit 21. Ordinarily, the longitudinal axis LF of the at least one face hole 39 is perpendicular to the face surface 29 so that α equals θ. Similarly, the longitudinal axis LG of the gauge hole 41 forms a non-zero angle β (FIG. 1D) with the longitudinal axis L of the drill bit 21 and, ordinarily, is perpendicular to the gauge 35 so that β equals Ω.

By providing a face surface 29 that is non-flat and has a center 33 that is axially forward of the outer edge 31 of the face surface, the wear volume of the face buttons 43 can be increased relative to buttons that are provided on flat surfaces.

The drill bit 21 comprises at least one and, ordinarily, a plurality of flow channels 47 extending through the bit and terminating at respective flow openings 49 in the face surface 29. As seen, for example, in FIG. 1D, the flow channel 47 can form an angle ϕ with the longitudinal axis L of the drill bit 21. The drill bit 21 further comprises at least one and, ordinarily, a plurality of axially extending grooves 51 in an external surface 53 of the drill bit. As seen for example in FIG. 1C, at least one flow channel 55 extends through the bit 21 and terminates at a respective flow opening 57 in the groove 51. The flow channel 55 can form an angle ω with the longitudinal axis L of the drill bit 21. The flow channels 47 and/or 55 ordinarily facilitate the introduction of flushing/cooling fluid to the hole being formed by the drill bit 21.

The drill bit 121 shown in FIGS. 2A-2I is in many ways similar to the drill bit 21 shown in FIGS. 1A-H. The drill bit 121 comprises a drill bit head 123 having a skirt 125 and a front surface 127. The front surface 127 comprises a face surface 129 from which a plurality of cutting surfaces are adapted to extend. The face surface 129 defines a forward-most end of the drill bit head 123. The face surface 129 has an outer edge 131. An entirety of the face surface 129 from which the cutting surfaces are adapted to extend can be non-flat so that a center 133 of the face surface is axially forward of the outer edge 131 of the face surface along a longitudinal axis L of the drill bit 121. As seen in FIGS. 2C-2D, 2G-2I, the face surface 129 is ordinarily conical or frustoconical (see, for example, dotted lines in FIGS. 1B and 1D), however, it may have other forms, such as being in the form of a plurality of concentric truncated cones, or a spherical or truncated sphere shape. The face surface 129 shown in FIGS. 2A-2I forms an angle θ with a perpendicular to the longitudinal axis L (similar to the angle θ of the face surface 29 shown in FIG. 1D).

The front surface 127 further comprises a gauge 135 surrounding the face surface 129. The gauge 135 has an inner edge 137. A transition region 138 extends in the direction of the longitudinal axis L of the drill bit 121 between the outer edge 131 of the face surface 129 and the inner edge 137 of the gauge 135.

In the drill bit 121, the gauge 135 comprises at least two gauge surfaces and, thus, is denominated a "twin gauge" drill bit for purposes of the present disclosure. The gauge 135 ordinarily comprises at least one and ordinarily a plurality of first gauge surfaces 135' and at least one and ordinarily a plurality of second gauge surfaces 135" that ordinarily define angles Ω' and Ω" with the perpendicular to the longitudinal axis L of the twin gauge drill bit 121 that are different from the angle θ that the face surface 129 forms with the perpendicular to the longitudinal axis L of the twin gauge drill bit and, ordinarily, are different from each other. The first gauge surface 135' extends over a first portion of a circumference of the gauge 135 and the second gauge surface 135" extends over a second portion of the circumference of the gauge. It will be appreciated that multi-gauge drill bits with still further gauge surfaces having characteristics different from the first and second gauge surfaces 135' and 135" can also be provided. A presently preferred design for the drill bit 121 includes a face surface 129 that forms an angle θ of about 13° with the perpendicular to the longitudinal axis L. A presently preferred design for the drill bit 121 includes a first gauge surface 135' that forms an angle Ω' of about 35° with the perpendicular to the longitudinal axis L and a second gauge surface 135" that forms an angle Ω" of about 30° with the perpendicular to the longitudinal axis L.

At least one and ordinarily a plurality of face holes 139 are provided in the face surface 129 for receiving face buttons 143 and a plurality of gauge holes are 141' and 141" are provided in the first and second gauge surfaces 135' and 135" for receiving gauge buttons 145' and 145" (face and gauge buttons are seen in FIGS. 2E-2I, and not shown in FIGS. 2A-2D), respectively. Because it forms a larger angle with the perpendicular to the longitudinal axis L, the first gauge surface 135' will ordinarily be wider than the second gauge surface 135" and, thus, facilitates forming a larger diameter gauge hole 141' than the hole 141" provided in the narrower second gauge surface. The face holes 139 can be positioned closer to the narrower second gauge surface 135" without interfering with their positioning relative to the position of face holes in other drill bit designs, such as the bit design 21 of FIGS. 1A-1H. The larger holes 139' of the first gauge surface 135' can receive larger buttons 141' that provide greater overall button volume and that, as they wear, can provide increased wear surface area and require removal of more button volume than would be the case in a conventional design requiring smaller buttons.

A longitudinal axis LF of the at least one face hole 139 forms a non-zero angle α with the longitudinal axis L of the twin gauge drill bit 121. Ordinarily, the longitudinal axis LF of the at least one face hole 139 is perpendicular to the face surface 129. Similarly, one or ordinarily both of the longitudinal axes LG' and LG" of the gauge holes 141' and 141" both form non-zero angles β' and β" with the longitudinal axis L of the twin gauge drill bit 121 and, ordinarily, one or both are perpendicular to the gauge 135 at the point where they are provided. The angles β' and β" are ordinarily different. By providing a face surface 129 that is non-flat and has a center 133 that is axially forward of the outer edge 131 of the face surface, the wear volume of the face buttons 143 can be increased relative to buttons that are provided on flat surfaces. Moreover, by providing the twin gauge arrangement, still further improvements in wear volume on gauge buttons can be achieved.

Figure 2A:
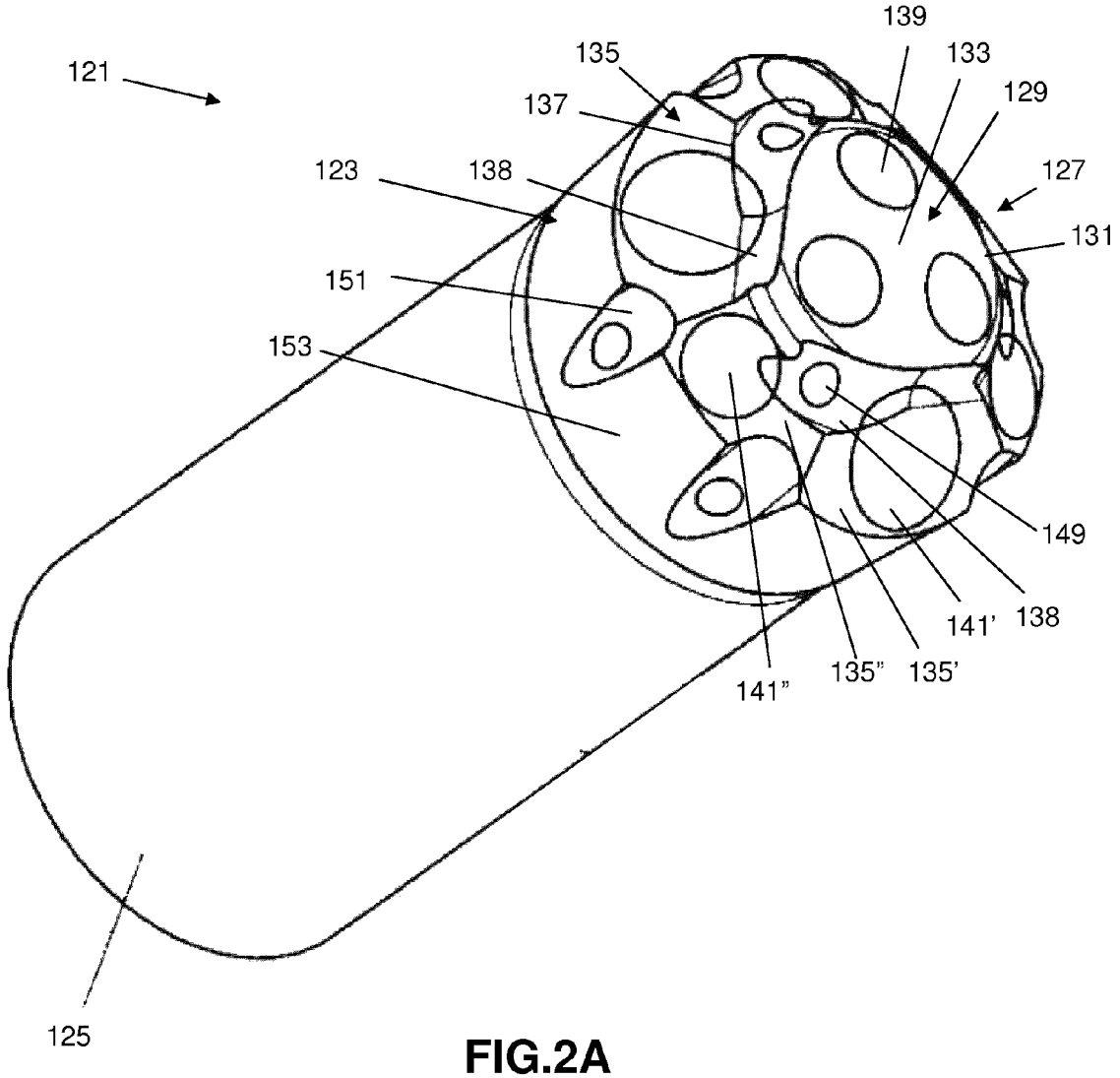
FIG. 2A is a perspective view of a twin gauge drill bit according to an aspect of the present invention.
Figure 2C:
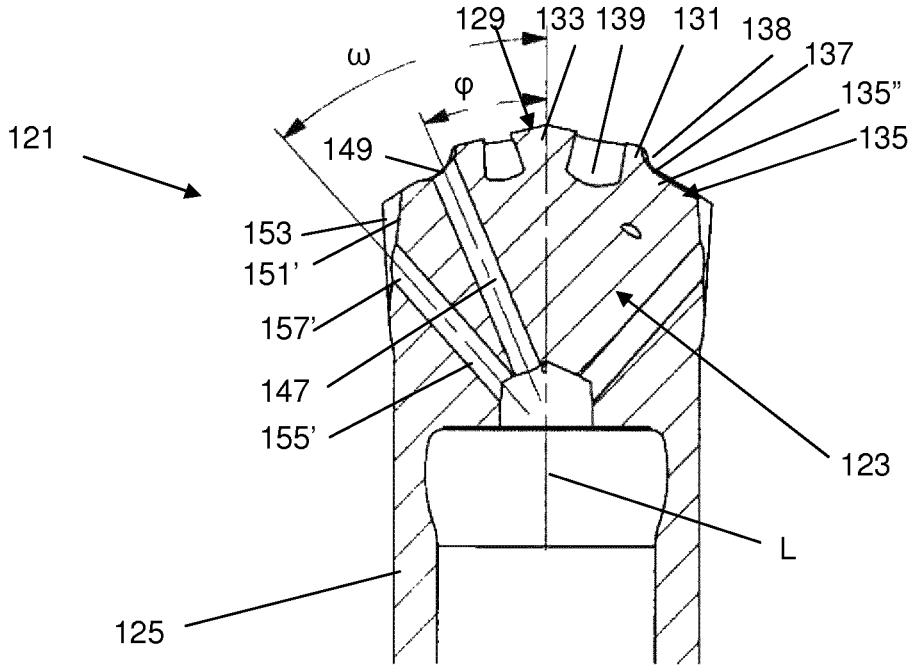
FIG. 2C is a side, cross-sectional view of the twin gauge drill bit of FIG. 2A taken at section 2C-2C of FIG. 2B.
Figure 2B:
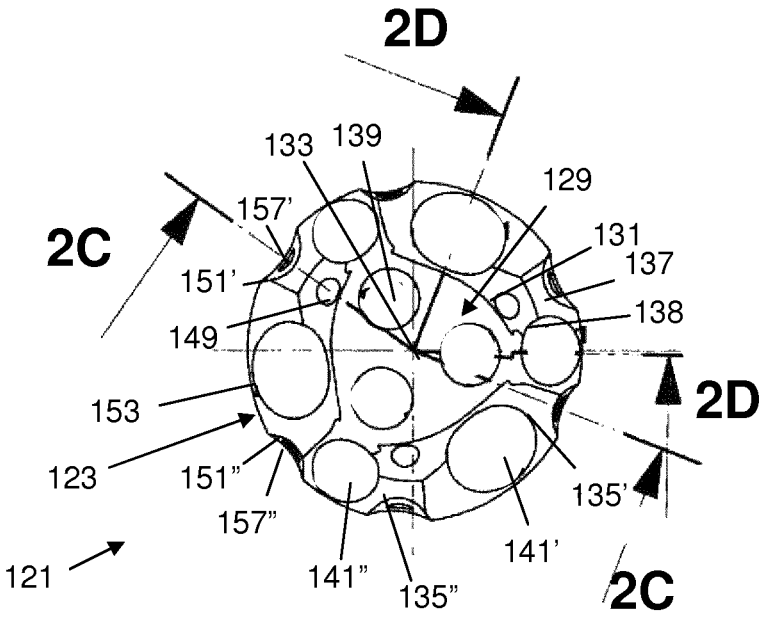
FIG. 2B is a top view of the twin gauge drill bit of FIG. 2A.
Figure 2D:
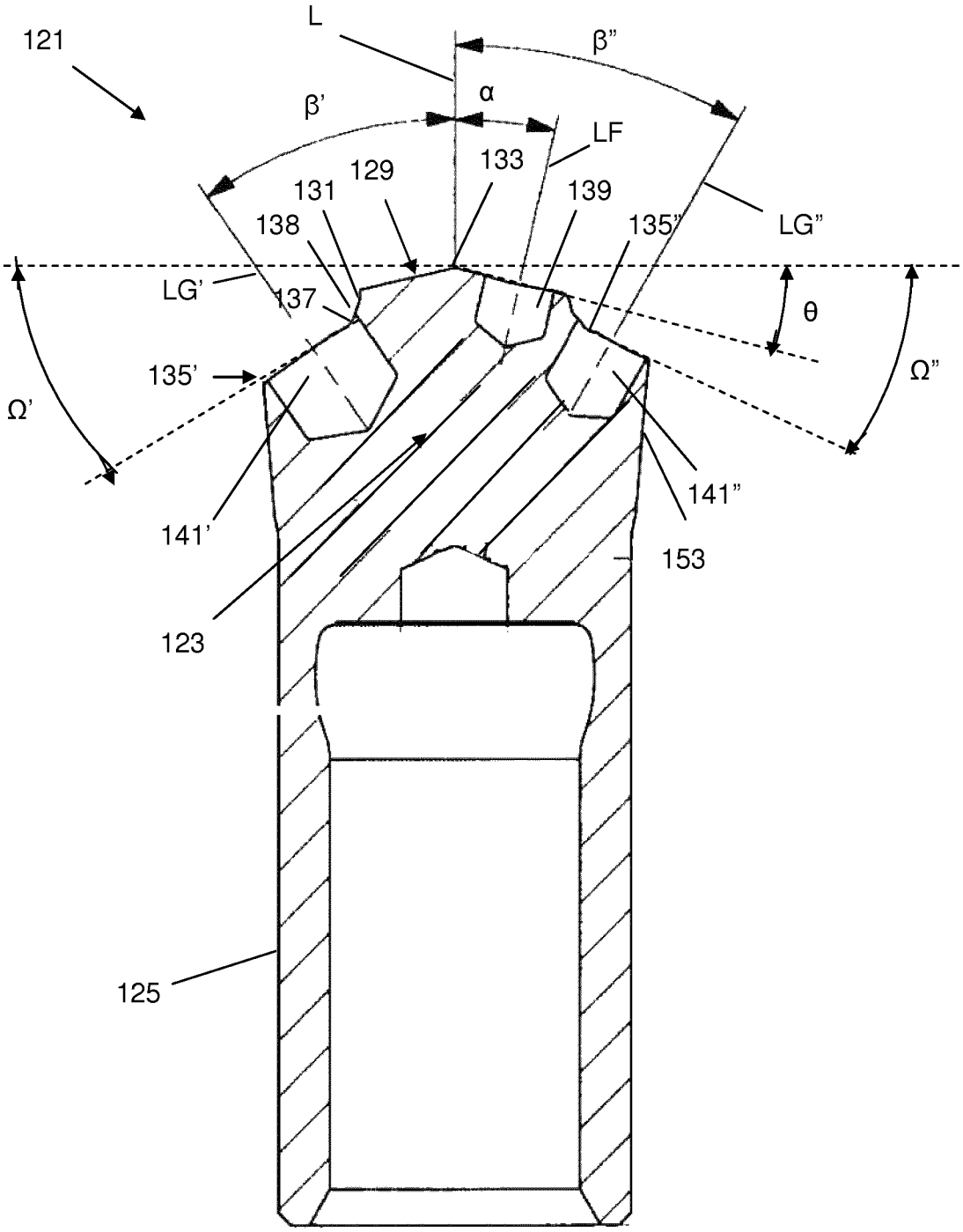
FIG. 2D is a side, cross-sectional view of the twin gauge drill bit of FIG. 2A taken at section 2D-2D of FIG. 2B.
Figure 2E:
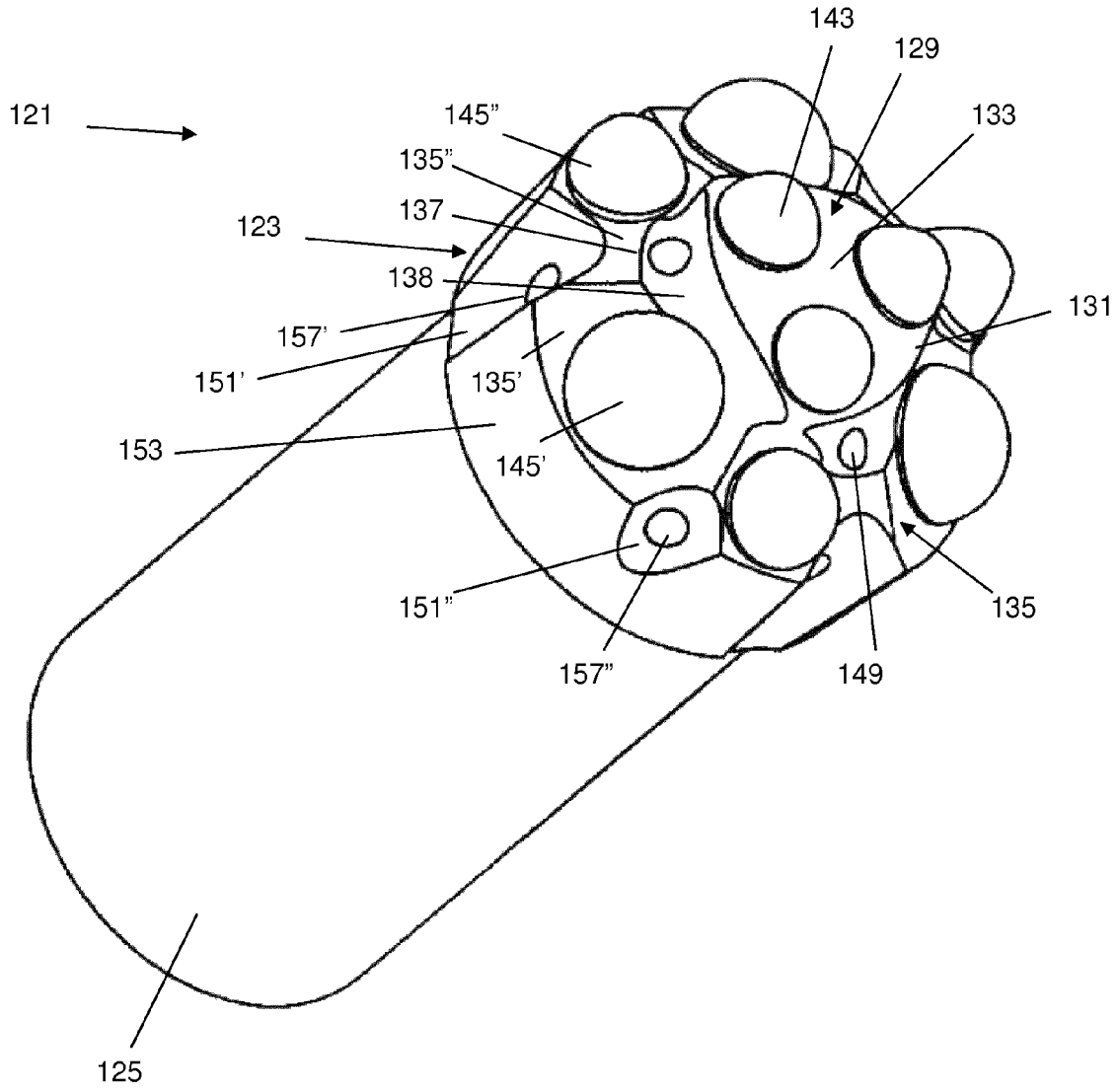
FIG. 2E is a perspective view of the twin gauge drill bit of FIG. 2A with buttons shown according to an aspect of the present invention.
Figure 2F:
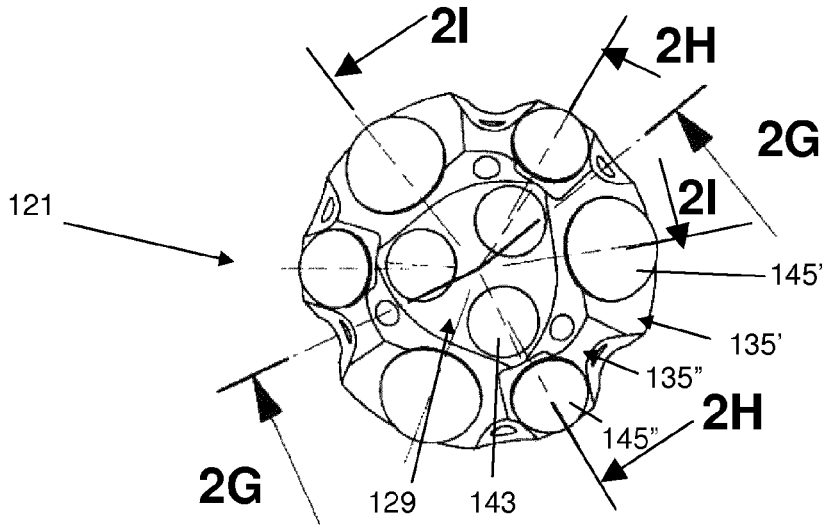
FIG. 2F is a top view of the twin gauge drill bit of FIG. 2E.
Figure 2G:
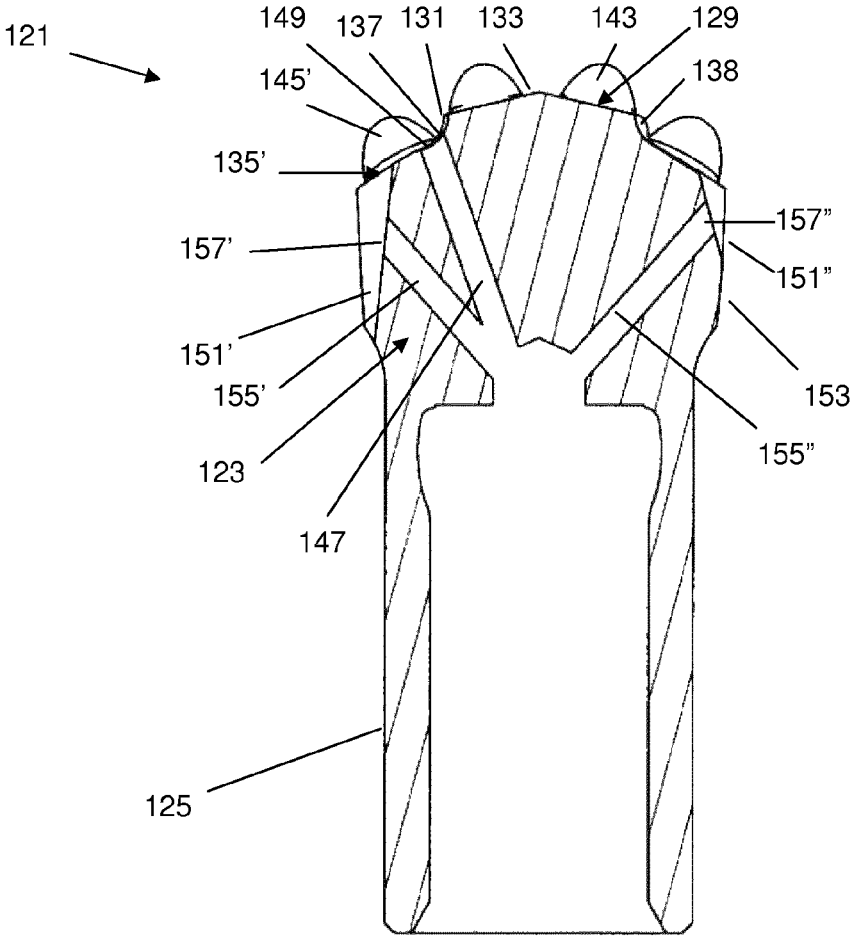
FIG. 2G is a side, cross-sectional view of the twin gauge drill bit of FIG. 2E taken at section 2G-2G of FIG. 2F.
Figure 2I:
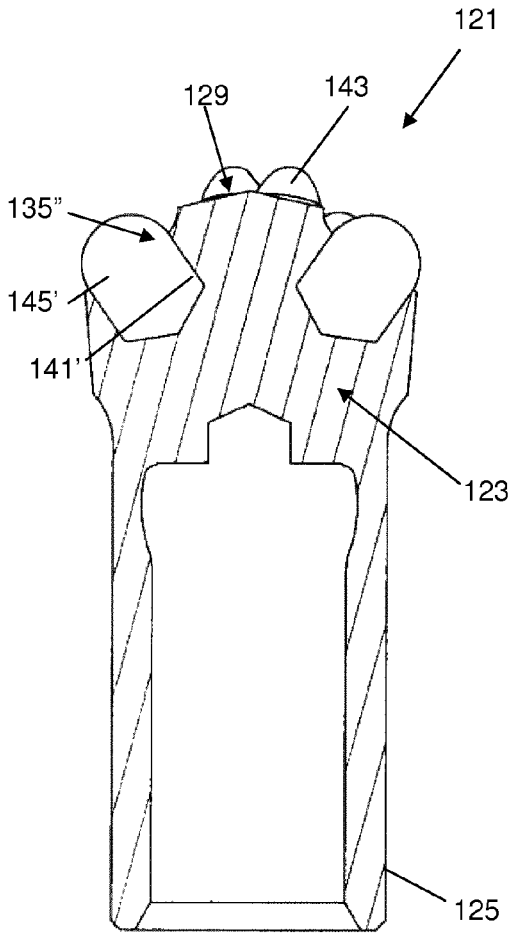
FIG. 2I is a side, cross-sectional view of the twin gauge drill bit of FIG. 2E taken at section 2I-2I of FIG. 2F.
Figure 2H:
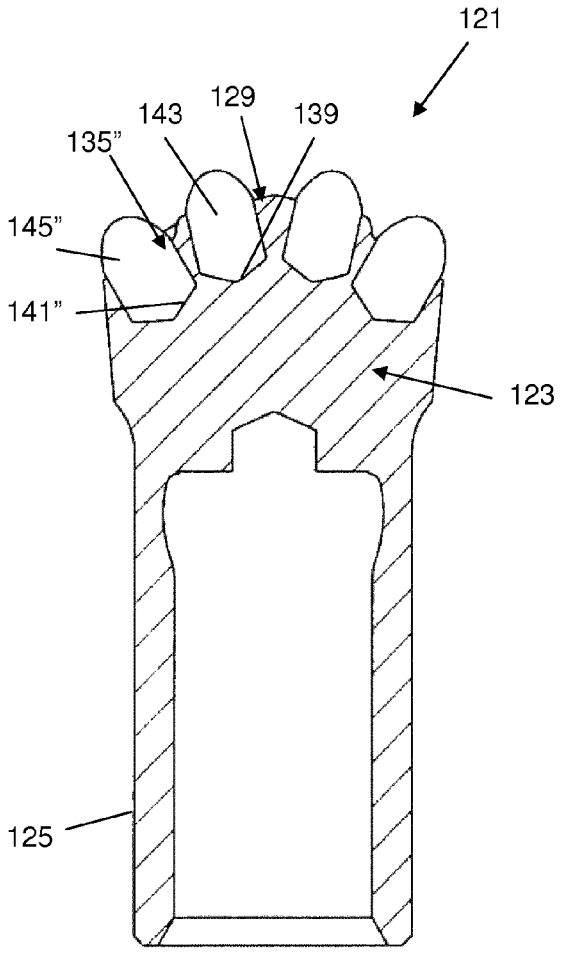
FIG. 2H is a side, cross-sectional view of the twin gauge drill bit of FIG. 2E taken at section 2H-2H of FIG. 2F.
Figure 3A:
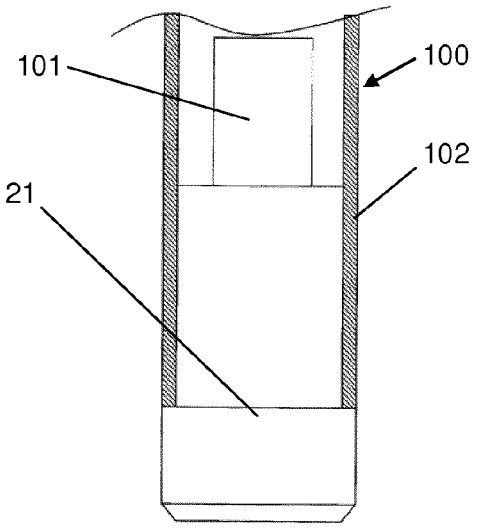
FIG. 3A is a schematic, cross-sectional view of a portion of a down-the-hole hammer type drill according to an aspect of the present invention.
Figure 3B:
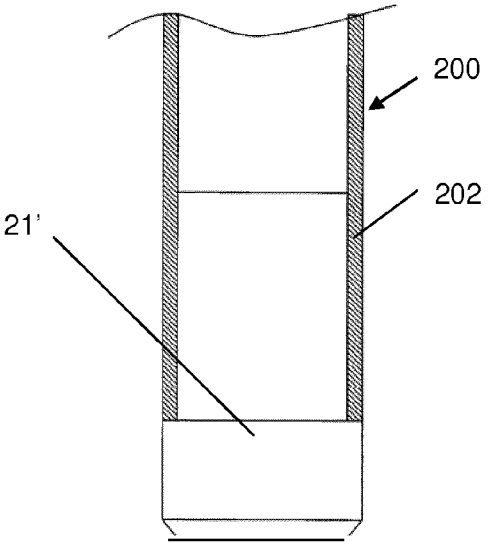
FIG. 3B is a schematic, cross-sectional view of a portion of a top hammer-type rock drill according to an aspect of the present invention.

The twin gauge drill bit 121 comprises at least one and, ordinarily, a plurality of flow channels 147 extending through the bit and terminating at respective flow openings 149 that may be located in the transition region 138, although they might also or alternatively be located in the face surface 129 or the gauge 135. The flow channels 147 can form an angle ϕ with the longitudinal axis L of the twin gauge drill bit 121. The twin gauge drill bit 121 further comprises at least one and, ordinarily, a plurality of axially extending grooves in an external surface 153 of the twin gauge drill bit. While all of the grooves 151 can be of the same shape as seen in FIG. 2A, it is also possible for some of the grooves 151' to be larger and some smaller 151" as shown in FIG. 2E to better facilitate accommodating different sized gauge surfaces 135' and 135". At least one flow channel 155' extends through the bit 121 and terminates at a respective flow opening 157' in the groove 151', and at least one flow channel 155" extends through the bit 121 and terminates at a respective flow opening 157" in the groove 151". The flow channel 155 can form an angle ω with the longitudinal axis of the drill bit 121. The flow channels 147 and/or 155 ordinarily facilitate the introduction of flushing/cooling fluid to the hole being formed by the twin gauge drill bit 121.

As seen, for example, in FIG. 2A, the first gauge surface 135' is wider than the second gauge surface 135". The transition region 138 is non-circular when viewed along the longitudinal axis L as seen, for example, in FIG. 2B. In the embodiment of FIGS. 2A-2I, there are three first gauge surfaces 135' that alternate with three second gauge surfaces 135" and the shape of the transition region 138 is consequently somewhat triangular. Providing first and second gauge surfaces 135' and 135" that are different sizes facilitates providing first and second gauge holes 141' and 141" that have different diameters. The first and/or the second gauge holes 141' and 141" may overlap onto the transition region 138.

Figure 5A:
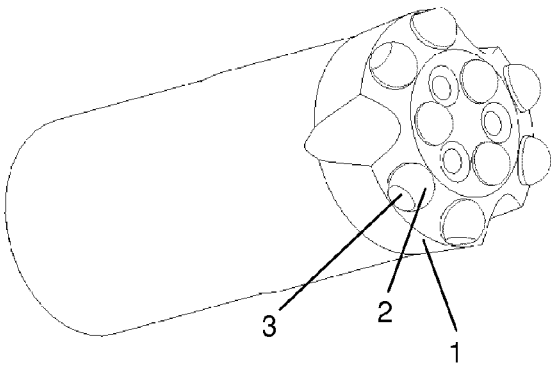
FIG. 5A is a perspective view of a worn drill bit according to the prior art.
Figure 5B:
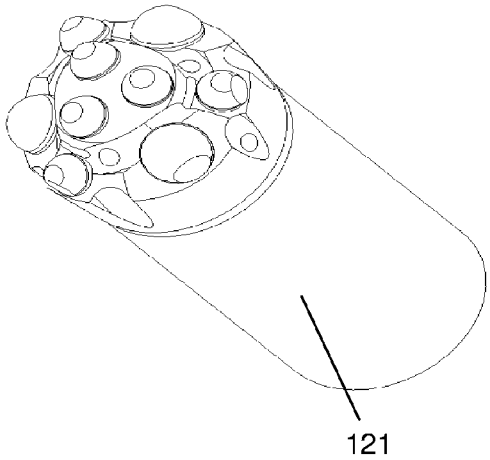
FIG. 5B is a perspective view of a worn twin gauge drill bit according to an aspect of the present invention.

The twin gauge drill bit 121 can provide substantial improvements in wear volume versus conventional drill bits 1 of the type shown in FIG. 5A that do not include twin gauges or a non-flat face surface but are otherwise similarly configured. FIG. 5A shows wear patterns on gauge buttons of a known rock drilling bit, Part No. 7738-5348-S48 available from Sandvik Mining and Construction Tools AB, Sandviken, Sweden, and FIG. 5B shows wear patterns on gauge buttons for a similarly configured twin gauge drill bit according to an aspect of the present invention. A comparison of the wear patterns on the gauge buttons of the bits of FIGS. 5A and 5B shows that the twin gauge design facilitates forming greater wear area as the gauge buttons are worn down. For example, in the illustrated design of FIG. 5B, larger gauge buttons can be provided at locations where they will not interfere with the face buttons, unlike in the design of FIG. 5A in which gauge buttons of the same size are provided around the constant width gauge. By providing larger gauge buttons, the wear area and the total volume of carbide available to be worn down can be increased.

Figure 4A:
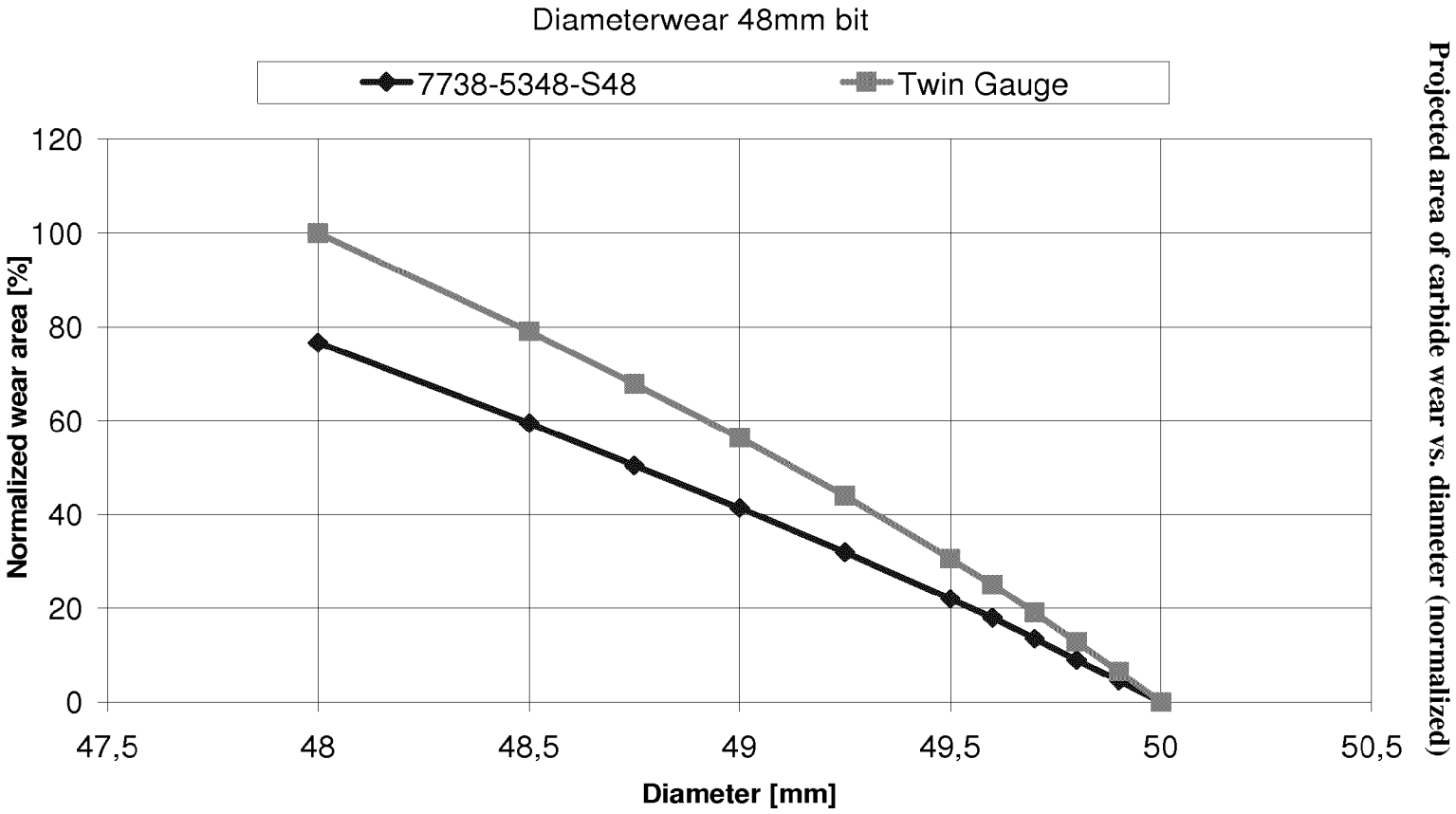
FIG. 4A is a graph of projected are of carbide wear versus diameter.
Figure 4B:
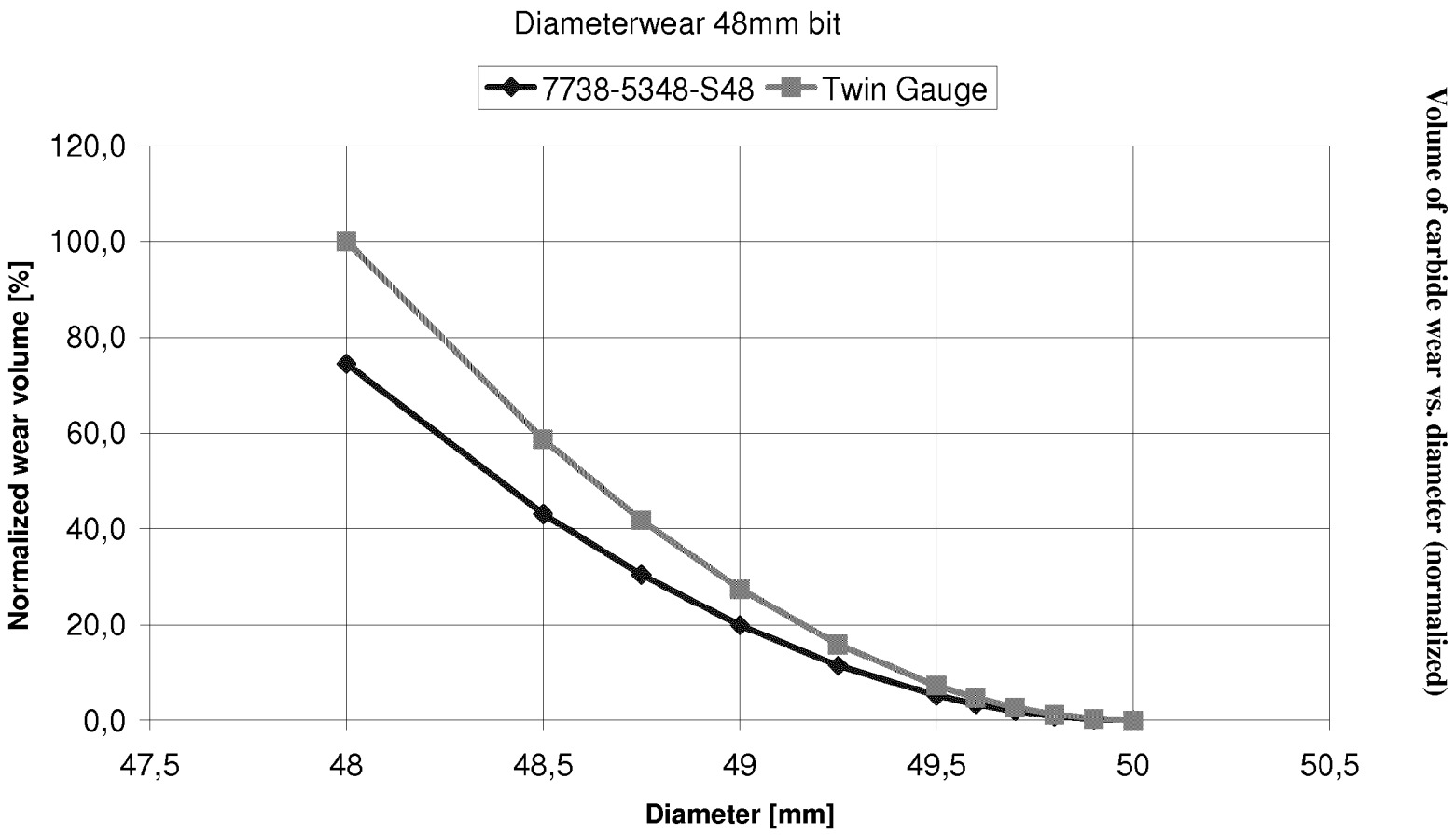
FIG. 4B is a graph of volume of carbide wear versus diameter.

The graphs of FIGS. 4A and 4B show that, as a conventional bit (lines with diamonds) and a twin gauge bit (lines with squares) wear down from 50 mm diameter to 48 mm diameter, the wear area (FIG. 4A) and the wear volume (FIG. 4B) becomes substantially greater for the twin gauge bit than for the conventional bit. As bit life is understood to primarily be directly related to wear volume and wear area, these graphs demonstrate that a bit such as the twin gauge bit can be expected to have a substantially improved life.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

The disclosures in EP Patent Application No. 11188761.8, from which this application claims priority, are incorporated herein by reference.

What is claimed is:

1. A drill bit for rock drilling tools, comprising:

a longitudinal axis;

a drill bit head having a front surface including a face surface having a plurality of cutting surfaces extending therefrom, the face surface defining a forward-most end of the drill bit head, the face surface having an outer edge and forming an angle with a perpendicular to the longitudinal axis of the drill bit;

a gauge surrounding the face surface, the gauge having an inner edge, wherein the gauge includes at least one first gauge surface defining a first angle with the perpendicular to the longitudinal axis over a first portion of a circumference of the gauge and at least one second gauge surface defining a second angle with the perpendicular to the longitudinal axis over a second portion of the circumference of the gauge, the first and second angles being different and the angle that the face surface forms with the perpendicular to the longitudinal axis being different from the first and second angles; and a transition region extending in a direction of the longitudinal axis of the drill bit between the outer edge of the face surface and the inner edge of the gauge, wherein an entirety of the face surface from which the plurality of cutting surfaces extend is not flat so that a center of the face surface is located axially forward of the outer edge of the face surface.

2. The drill bit as set forth in claim 1, wherein the at least one first gauge surface is wider than the at least one second gauge surface.

3. The drill bit as set forth in claim 1, further comprising a plurality of first gauge surfaces and a plurality of second gauge surfaces.

4. The drill bit as set forth in claim 1, wherein the transition region is non-circular when viewed along the longitudinal axis.

5. The drill bit as set forth in claim 1, further comprising at least one face hole in the face surface and at least one gauge hole in the gauge for receiving face buttons and gauge buttons, respectively, wherein a longitudinal axis of the at least one face hole forms a non-zero angle with the longitudinal axis.

6. The drill bit as set forth in claim 5, wherein the longitudinal axis of the at least one face hole is perpendicular to the face surface.

7. The drill bit as set forth in claim 1, wherein the face surface is conical.

8. The drill bit as set forth in claim 1, wherein a first gauge hole is provided in the first gauge surface and a second gauge hole is provided in the second gauge surface.

9. The drill bit as set forth in claim 8, wherein the first gauge hole and the second gauge hole have different diameters.

10. The drill bit as set forth in claim 8, wherein a longitudinal axis of the first gauge hole and a longitudinal axis of the second gauge hole define non-zero angles with the longitudinal axis of the drill bit.

11. The drill bit as set forth in claim 10, wherein the longitudinal axis of the first gauge hole and the longitudinal axis of the second gauge hole define different non-zero angles with the longitudinal axis of the drill bit.

12. The drill bit as set forth in claim 10, wherein the longitudinal axis of the first gauge hole is perpendicular to the at least one first gauge surface.

13. The drill bit as set forth in claim 1, further comprising at least one flow channel extending through the drill bit and terminating at a respective flow opening in the transition region and/or in the face surface.

14. The drill bit as set forth in claim 1, further comprising at least one axially extending groove in an external surface of the drill bit, and at least one flow channel extending through the drill bit and terminating at a respective flow opening in the groove.

15. The drill bit of claim 1, wherein the face surface is frustoconical.

16. A drilling tool comprising a drill bit including a longitudinal axis; a drill bit head having a front surface having a face surface and a plurality of cutting surfaces extending therefrom, the face surface defining a forward-most end of the drill bit head, the face surface having an outer edge and forming an angle with a perpendicular to the longitudinal axis of the drill bit; a gauge surrounding the face surface, the gauge having an inner edge, wherein the gauge includes a first gauge surface defining a first angle with a perpendicular to the longitudinal axis over a first portion of a circumference of the gauge and a second gauge surface defining a second angle with the perpendicular to the longitudinal axis over a second portion of the circumference of the gauge, the first and second angles being different and the angle that the face surface forms with the perpendicular to the longitudinal axis being different from the first and second angles; and a transition region extending in a direction of the longitudinal axis of the drill bit between the outer edge of the face surface and the inner edge of the gauge, wherein an entirety of the face surface from which the plurality of cutting surfaces is not flat so that a center of the face surface is located axially forward of the outer edge of the face surface.

* * * * *